US005937609A

United States Patent [19]

Roth

[11] Patent Number: 5,937,609

[45] Date of Patent: Aug. 17, 1999

[54] CONCRETE INSERT TO SUPPORT ANCHOR BOLT

[76] Inventor: Steven A. Roth, 12 Lahoma Ct., Alamo, Calif. 94507

[21] Appl. No.: 08/563,077

[22] Filed: Nov. 27, 1995

[51] Int. Cl.[6] ..... E04B 1/38; E04C 5/00

[52] U.S. Cl. ..... 52/698; 52/699; 52/700; 52/701; 52/712

[58] Field of Search ..... 52/699, 700, 701, 52/698, 707, 70 P, 709, 710, 712

[56] References Cited

U.S. PATENT DOCUMENTS

| | | | |
|---|---|---|---|
| 3,705,469 | 12/1972 | Eriksson | 52/701 X |
| 3,715,850 | 2/1973 | Chambers | 52/701 |
| 3,884,008 | 5/1975 | Miller | 52/699 |
| 4,412,407 | 11/1983 | Melfi et al. | 52/701 X |
| 5,205,690 | 4/1993 | Roth | 41/82 |
| 5,337,534 | 8/1994 | Nasca | 52/699 X |

FOREIGN PATENT DOCUMENTS

| | | | |
|---|---|---|---|
| 1217266 | 5/1968 | United Kingdom | 52/700 |

OTHER PUBLICATIONS

Pipe Hangers and Supports/Tolco Incorporated/Nov. 1, 1990 pp. 67, 68, 69.

Pipe and Conduit Support Systems/Kin–Line, Inc./1986 pp. 88 and 89.

Price list No. 291/Michigan Hanger Co., Inc./Feb. 1, 1991 p. 35.

*Primary Examiner*—Lanna Mai

*Assistant Examiner*—W. Glenn Edwards

*Attorney, Agent, or Firm*—Glen R. Grunewald

[57] ABSTRACT

A concrete insert with a C-shape and having a flat bottom plate and a top plate connected by a side plate with the planes of the top and bottom plates being parallel, each of the top plate and bottom plate containing a hole with centers of those holes lying on the same axis, and means associated with the top and bottom holes to engage a threaded support rod.

9 Claims, 3 Drawing Sheets

CONCRETE INSERT TO SUPPORT ANCHOR BOLT

TECHNICAL FIELD

This invention is in the field of inserts for concrete construction, the inserts being useful for attaching items to concrete after it hardens.

BACKGROUND ART

Concrete inserts are used to connect items to concrete structures after the concrete has been poured and hardened. A typical use of an insert is to embed it in a concrete ceiling so that an anchor bolt may support a pipe hanger or the like to the ceiling after the concrete hardens. The following description will concern inserts embedded in ceilings although the inserts of this invention may also be embedded in concrete floors or walls.

Some prior art inserts are U-shaped sheet metal pieces with legs terminating in flanges that lie in a common plane and with a bridge between the legs having a hole in it through which a threaded fastener is inserted. An internally threaded coupling is positioned between the legs of the U-shaped piece to butt against the bridge, and a threaded fastener is screwed into the internal threaded cavity of the coupling and locked in place with a nut that abuts the bridge. Concrete inserts of this nature are known, a typical example of which is illustrated as item 276 on page 89 of the 1986 catalog published by Kin-Line, Inc., located at 6425 San Leandro Street, Oakland, Calif. 94614. An improved version of this type of insert is disclosed in U.S. Pat. No. 5,205,690. A problem with inserts of this type is that if metal forms are used that are not stripped after the concrete hardens, holes for support rods must be drilled before concrete is poured and the insert bridges the holes in the form so that the concrete, before it sets, can flow into the hole unless measures are taken to prevent that flow. Additionally, the bridge of the insert must be aligned with the hole in the form through which a threaded support rod passes, and that alignment must be maintained during the concrete pour if the support rod is to be vertical after the concrete hardens.

Other inserts are simply elongated metal pieces from which support rods extend, the elongated metal pieces having legs that hold a bridge high enough above the form so that poured concrete may flow beneath the bridge to hold it firmly after the concrete hardens. A typical insert of this type is #370 Metal and Concrete Insert manufactured by Michigan Hanger Co., Inc. of Niles, Ohio and illustrated on page 35 of Price List No. 291 published by that company. This type of hanger is extremely unstable prior to and during a concrete pour and cannot be used with a wooden form because use of a wooden form requires a threaded element that is flush with the concrete ceiling after the form is removed.

Another prior art concrete insert is typified by FIG. 109EZ of the Tolco Incorporated catalog published Nov. 1, 1994. The 109EZ insert is illustrated on page 68 of that catalog and a similar insert identified as a 109 insert is illustrated at page 69 of that catalog. Both illustrated inserts have an L-shaped threaded rod that extends through a metal piece bridging two of the lands of a corrugated metal form. The illustrated inserts cannot be used with wooden forms, and when they are subjected to heavy loads the L-shaped rods tend to straighten and extrude out of the ceiling. In addition, the hole in the metal form through which the support rod extends must be protected from leaking concrete during the pour, and the insert is unstable during a concrete pour so that it can be tilted with the result that the support rod will not be vertical after the concrete hardens. Both of the above-noted inserts are illustrated on page 89 of the Kin-Line, Inc. catalog, copyrighted 1986. Item 276 on that page is a spot insert such as described above which is useful only with wooden forms, while item 293 is the L-shaped support rod that is useful only with metal forms.

SUMMARY OF THE INVENTION

This invention is an improved concrete insert which is stable during a concrete pour and, when concrete hardens the insert, forms a cell to contain concrete on four sides of a six-sided volume. The insert of this invention has a flat bearing-plate at the hole which is required for a metal form to prevent concrete leakage during the pour, and it lies flat on the surface of a wood form so that it will be flush with the ceiling when the form is removed. The insert of this invention captures a cell of concrete to provide symmetric loading of the support rod, and its stable position on a form prevents tipping of the insert during a concrete pour. Spaced threaded attachments in the insert of this invention prevent pull-out of the metal support rod and guarantee vertical alignment of the support rod during a concrete pour and after the concrete hardens. Some embodiments of the insert of this invention can be used without separate nuts and washers so that a contractor using the insert of this invention does not require a supply of nuts, bolts, or washers of various sizes or the time required in installing them on the insert during construction of a concrete ceiling.

These advantages are obtained by the insert of this invention which includes at least a C-shaped metal piece with a lower plate, an upper plate, and a side plate which connects the lower plate and the upper plate. The upper plate and lower plate have axially aligned holes that are either threaded or associated with threaded elements that provide the same function as those holes being threaded. Within the broad concept of this invention the term "at least a C-shaped cross-section" includes metal shapes that enclose three sides of a six-sided volume whether in planar or rounded shapes. However, in all cases the lower plate of the insert of this invention is flat. Additionally, in the context of this invention the concepts of upper, lower, vertical and horizontal are intended to be used in the context of an insert embedded in a ceiling to hold such things as pipes, duct work, electrical wiring, etc. However, the device of this invention may be used in floors or in walls by suitably adjusting the techniques of installing them in known manners, and in those instances the orientation with respect to vertical and horizontal may be reversed. Additionally, the concept of threads associated with upper and lower holes includes the most direct form—i.e., that the holes in the upper plate and the lower plate are threaded holes, and that concept also includes threaded connection to a support rod that is associated with the upper hole and with the lower hole so that vertical alignment of a support rod is maintained by threads associated with the axially aligned upper and lower holes of the insert.

DETAILED DESCRIPTION OF THE DRAWINGS

Figure 1:
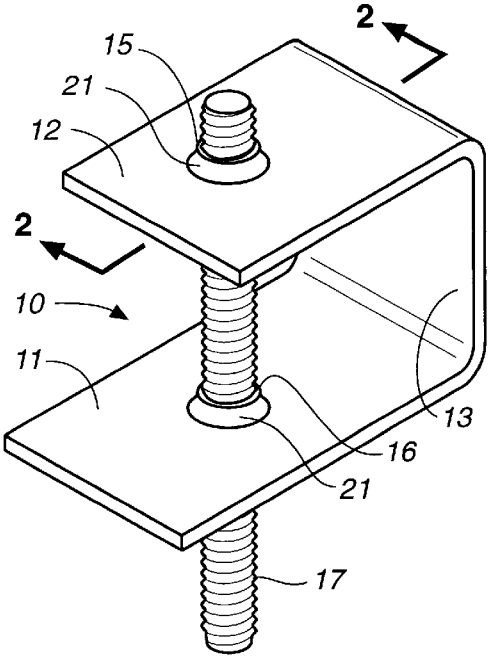
FIG. 1 is a perspective view of an insert embodying this invention.
Figure 2:
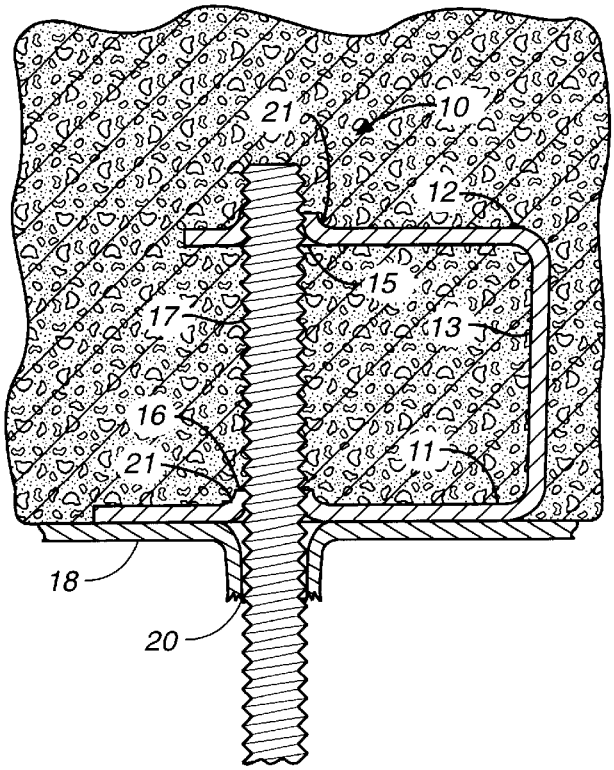
FIG. 2 is a cross section of the insert of FIG. 1 taken on the plane of the line 2—2 illustrating the insert installed on a metal concrete form and embedded in concrete.

FIGS. 1 and 2 illustrate a typical embodiment of the concrete insert of this invention. The insert, generally designated 10, includes a lower plate 11, an upper plate 12 and a side plate 13 which are all bent from the same piece of metal. The insert has a general C-shape with bottom plate 11 and top plate 12 parallel to one another and side plate 13 perpendicular to the planes of both. Although illustrated in this manner, the insert may have other shapes as long as the bottom plate 11 is flat. Top plate 12 includes a threaded hole 15 and bottom plate 11 includes a threaded hole 16. The center of threaded holes 15 and 16 are axially aligned so that a threaded hanger rod 17 may be threaded into both holes and be held vertically when bottom plate 11 lies flat on a concrete form such as metal form 18 illustrated in FIG. 2. Metal form 18 includes a punched hole 20 through which hanger rod 17 extends, and if metal form 18 is horizontal, then hanger rod 17 will extend through hole 20 vertically. Threaded holes 15 and 16 are illustrated as being punched holes which have protruding bent areas 21 which can be threaded as is well known to the art. Punched hole 20 in the metal form 18 is formed to be large enough to accept threaded rod 17 by just passing rod 17 through hole 20 without a threaded engagement.

The embodiment illustrated in FIGS. 1 and 2 is employed by placing an insert 10 above each of any number of holes 20 which are punched in pre-selected positions so that hanger rods will be available where they are desired after a ceiling is formed by pouring concrete on the upper side of form 18 and letting it harden with the inserts in place and with threaded hanger rod 17 extending through the holes 20.

Figure 3:
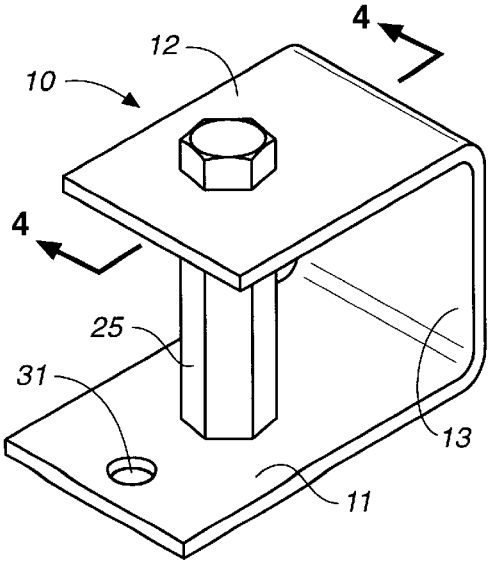
FIG. 3 is a perspective view of another insert embodying this invention.
Figure 4:
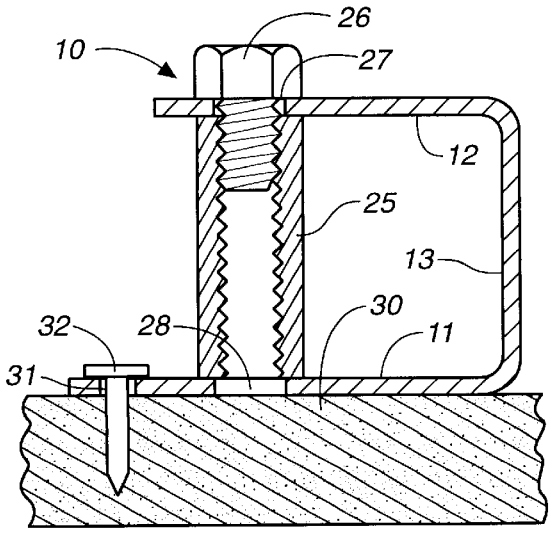
FIG. 4 is a cross section of the insert of FIG. 3 taken on the plane of the line 4—4 and illustrating the insert installed on a wood deck form.

FIGS. 3 and 4 illustrate an embodiment of this invention for use with wood forms. As in FIGS. 1 and 2 the insert of FIG. 3 has a bottom plate 11, a top plate 12, and a side plate 13 with the plates oriented as in FIGS. 1 and 2. The embodiment of FIGS. 3 and 4 is especially useful for use with a wood form 30. Metal forms such as form 18 are normally left in place after concrete hardens, whereas ceilings cast using wood forms such as form 30 normally have the wood stripped from the concrete after it hardens. As a result, inserts such as those illustrated in FIGS. 3 and 4 do not have threaded hanger rods installed before the concrete is cast and thus require a threaded element such as coupling 25 to be incorporated in the insert. It is evident from FIG. 4 that when wood form 30 is stripped from the cast ceiling the hole 28 in bottom plate 11 will be exposed and flush with the surface of the ceiling that was cast on top of form 30. Hole 28 is larger than the threaded interior of coupling 25 so that when form 30 is stripped from the ceiling a threaded hanger rod may be threaded into coupling 25 to extend vertically from the formed ceiling. The embodiment of FIGS. 3 and 4 differs from the embodiment of FIGS. 1 and 2 in that a bolt 26 is provided to hold coupling 25 securely aligned with upper hole 27 and to keep concrete from flowing into the threaded cavity of coupling 25 during a pour of concrete. Additionally, lower hole 28 is larger in diameter than the interior diameter of the threaded bore in coupling 25 so that a threaded hanger rod can easily be installed in the coupling. Additionally, a hole 31 is provided in bottom plate 11 so that a nail 32 can be employed to hold bottom plate 11 in exactly the position desired and to stabilize the entire insert during the concrete pour.

The sequence for using the insert illustrated in FIGS. 3 and 4 is for the wood form 30 to be installed horizontally and parallel to the plane of the floor of the room in which a ceiling is being made, to position inserts above the form wherever hanger rods are desired in the ultimate ceiling that is to be made, and to fix those inserts in position using nails 32, then to pour concrete on top of form 30 to completely surround the insert, and after the concrete hardens to strip the form 30 from the hardened concrete ceiling after which lower plate 11 will be flush with the concrete ceiling and hole 28 will be open providing access to the threaded interior of coupling 25 so that threaded hanger rods such as rods 17 illustrated in FIGS. 1 and 2 can be installed. Threaded hanger rods installed in this way can be of any length and they can be removed or changed at any time.

In the embodiments of FIGS. 1–4 it is evident that poured concrete will fill the volume surrounded by plates 11, 12 and 13 and will completely surround either the threaded hanger rod 17 or the coupling 25 so that when the concrete hardens, a cell of concrete is captured by the insert of this invention; whereby the parallel plates 11 and 12 cannot bend nor can plate 13 be crushed and the vertical axial alignment of the threaded portions of plates 11 and 12, as shown in FIG. 1, and the vertical alignment of coupling 25, as shown in FIGS. 3 and 4, is established by being embedded in hardened concrete. In all embodiments there is a lower threaded element and an upper threaded element in axial alignment with each other so that the vertical position of rod 17 is established when the inserts are installed and before concrete is poured, and that vertical aspect is maintained during the pour and after the hardening of the concrete. In FIGS. 1 and 2 the upper threaded element and the lower threaded element are threaded holes 15 and 16, while in FIGS. 3 and 4 threaded means operative with the upper hole 27 and with lower hole 28 are, respectively, the upper portion of coupling 25 and the lower portion of coupling 25 which produce the same function as the spaced, threaded, separate holes 15 and 16 of the embodiment of FIGS. 1 and 2.

Figure 5:
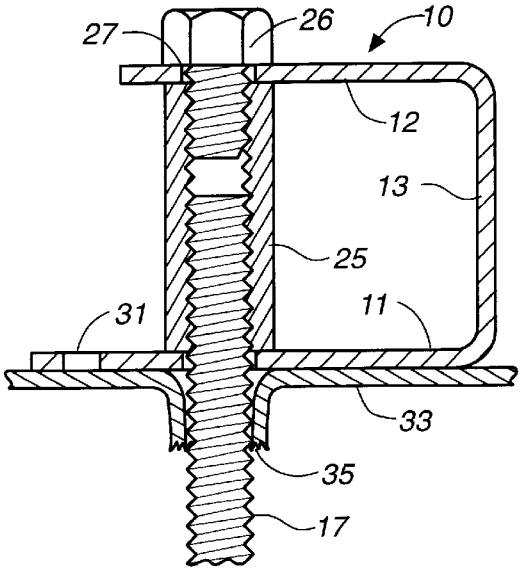
FIG. 5 is a cross section of another embodiment of this invention installed on a metal concrete form, the embodiment of FIG. 5 having a removable hanger rod.

The embodiment of FIG. 5 illustrates that a coupling 25 may also be employed when the insert of this invention is installed on metal form 33. In the embodiment of FIG. 5 the upper threaded portion and the lower threaded portion functions are provided by the upper and lower portions of threaded coupling 25, as in the embodiment of FIGS. 3 and 4; and in order to maintain the interior of threaded coupling 25 free of concrete during the pour of concrete a bolt 26 is employed to seal the upper portion of the cavity of coupling 25 during the pour. The embodiment of FIG. 5 is illustrated with metal form 33 instead of wood form 30 and with a punched hole 35 that is large enough to accept hanger rod 17 without a threaded engagement. The embodiment of FIG. 5 also illustrates that concrete cannot flow through hole 35 during the pour because it is sealed by bottom plate 11 and the tight threaded engagement of coupling 25. Hole 31 is illustrated in FIG. 5 so that the insert may be held in place during the pour by the use of a tack weld or the like through hole 31.

Figure 6:
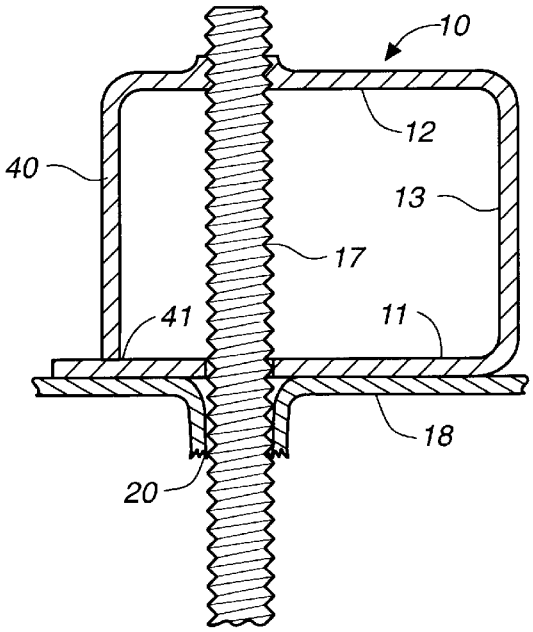
FIG. 6 is a cross section of another embodiment of this invention installed on a metal form.

The embodiment of this invention illustrated in FIG. 6 includes all of the elements of the embodiment of FIGS. 1 and 2 and additionally employs an end plate 40 shown as a bent extension of upper plate 12 which extends vertically downwardly to abut bottom plate 11 at 41. In the embodiment of FIG. 6 the captured cell of concrete holding the insert in place is surrounded by metal plates on four sides whereby the symmetry of the load on hanger rod 17 is insured during the concrete pour. In other words, the cell of hardened concrete captured in insert 10 prevents crushing, tipping or sliding of the insert whereby its position is maintained stably both during a concrete pour and after the poured concrete has hardened.

Figure 7:
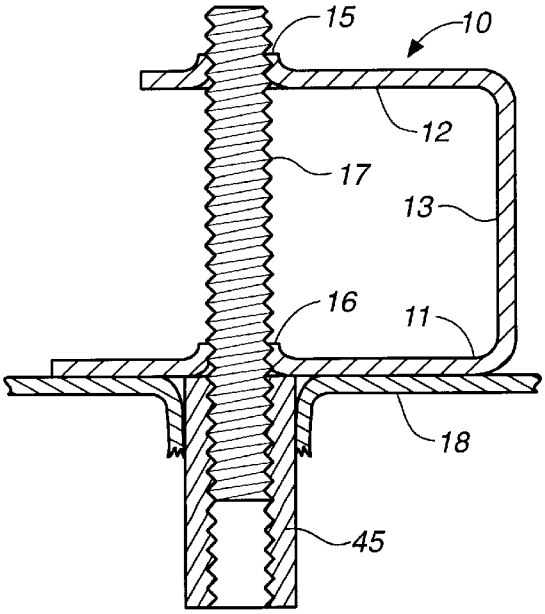
FIG. 7 illustrates an embodiment of FIG. 2 adapted to use removable threaded support rods.

The embodiment illustrated in FIG. 7 is useful when providing inserts to support hanger rods of indeterminate length. In the embodiment of FIG. 7 the hole 20 in metal form 18 is large enough to accept a coupling 45 which will accept the end portion of threaded hanger rod 17 in its upper portion and has a threaded lower portion to accept the end of a threaded hanger rod of any length or to accept a hanger rod that can be interchanged with other hanger rods if different lengths are required.

Figure 8:
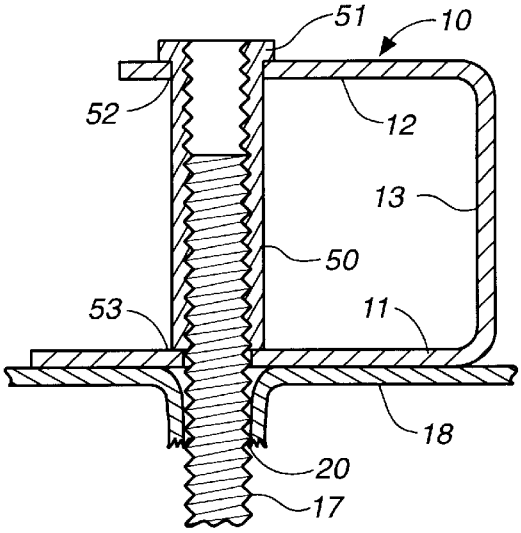
FIG. 8 is a cross section of another embodiment of this invention including an elongated threaded element that provides threads associated both with the upper hole and the lower hole of the insert.

In the embodiment of FIG. 8 upper plate 12 is provided with a hole 52 that is not threaded and is large enough to accept an internally threaded bushing 50; and lower hole 53 in bottom plate 11 is large enough to accept hanger rod 17 without threaded engagement. The bushing 50 is provided with an upper flange 51 that engages top plate 12; and lower plate 11 is provided with a hole 53 large enough to accept rod 17 to just slide through it and punched hole 20 in form 18. Bushing 50 may have a surface that is knurled or roughened to engage concrete after it hardens.

Figure 9:
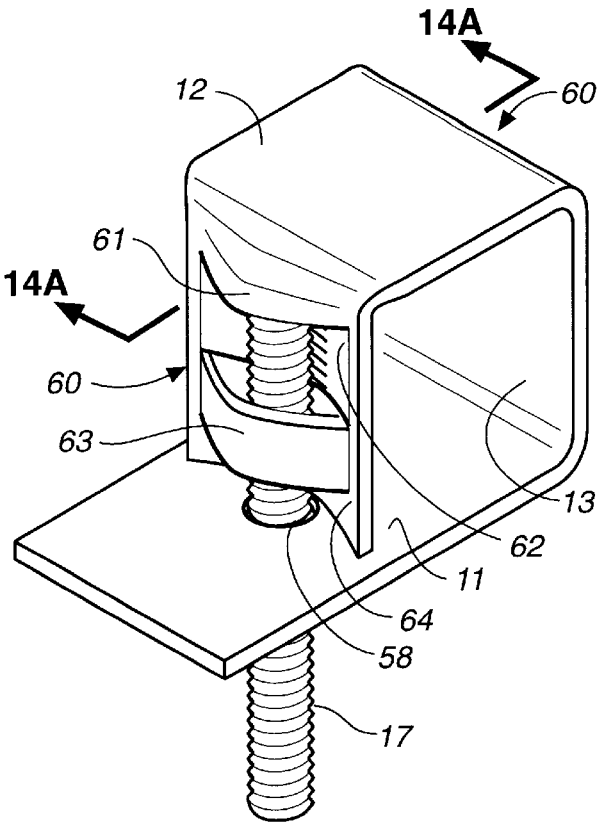
FIG. 9 is a perspective view of another embodiment of this invention.
Figure 10:
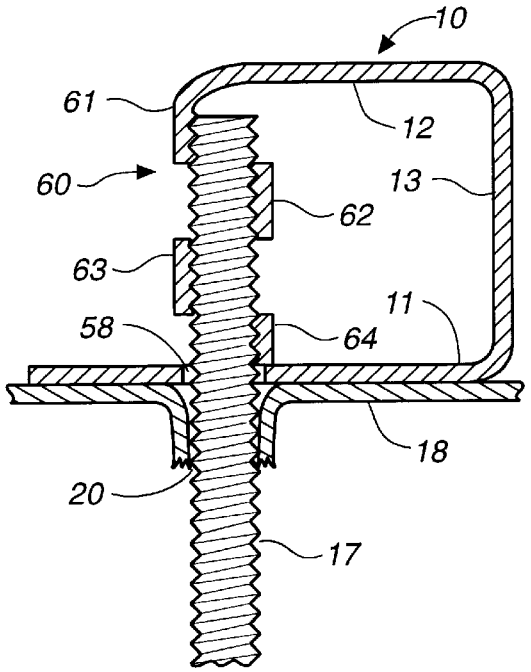
FIG. 10 is a cross section of the embodiment of FIG. 9 taken on the plane of the line 10—10.

The embodiment of this invention illustrated in FIGS. 9 and 10 includes a threaded wall element generally designated 60. In the illustrated embodiment wall element 60 is a vertical extension of upper plate 12 bent downwardly toward lower plate 11. The wall element 60 includes a number of threaded segments shown as 61, 62, 63 and 64, those threaded segments being formed by punching arcuate segments from the wall 60 and threading them as illustrated and as is known to the art. The embodiment of FIGS. 9 and 10 show bent segment 64 as being a threaded engagement for the lower portion of the insert and bent segment 61 as being a threaded engagement for the upper portion of the insert whereby the rod 17 is held in a position perpendicular to lower plate 11 and aligned with hole 58 and, therefore, when installed in a ceiling, held to be vertical. In the embodiment of FIGS. 9 and 10, segment 61 performs the function of a hole in upper plate 12.

What is claimed is:

1. In combination, a concrete form and a concrete insert for use therewith comprising:

a substantially horizontal form for casting a concrete ceiling having mounted on its upper surface an insert comprising a flat lower plate, wherein the entire flat lower plate is in contact with said upper surface, said lower plate including a first hole to receive a threaded load-supporting rod;

an upper plate vertically spaced from said lower plate, said upper plate including a second hole to receive said load-supporting rod, the centers of said first hole and said second hole lying on a common axis that is perpendicular to the plane of said lower plate;

a side plate connecting said lower plate and said upper plate;

threaded means operative with said first hole and threaded means operative with said second hole to engage said threaded rod, whereby when concrete is cast on said horizontal form said insert is embedded in said concrete.

2. The combination of claim 1 including means to attach said lower plate said concrete form.

3. The combination of claim 1 wherein said side plate lies in a plane substantially perpendicular to the plane of said lower plate.

4. The insert of claim 1 wherein a second side plate extends between said first plate and said second plate, said second side plate positioned so that said common axis lies between said first side plate and said second side plate.

5. The insert of claim 1 wherein said threaded means comprises internally threaded ed bushing.

6. The combination of claim 1 wherein said threaded means comprises threads tapped in said first hole.

7. The combination of claim 1 wherein said threaded means comprises threads tapped in said second hole.

8. The combination of claim 1 wherein said threaded means comprises a threaded wall segment including a plurality of bent-out threaded segments.

9. A concrete ceiling having embedded therein an insert comprising a flat lower plate including a first hole, an upper plate vertically spaced from said lower plate, said upper plate including a second hole, a side plate connecting said lower plate and said upper plate, threaded means operative with said first hole and threaded means operative with said second hole, and a threaded rod in threaded engagement with said threaded means of said first and second holes and extending below said lower plate.

* * * * *